US006676368B2

(12) United States Patent
Carboneri et al.

(10) Patent No.: US 6,676,368 B2
(45) Date of Patent: Jan. 13, 2004

(54) TURBINE PUMP WITH A STATOR STAGE INTEGRATED WITH A SPACER RING

(75) Inventors: Roberto Carboneri, Turin (IT); Silvio Giors, Turin (IT)

(73) Assignee: Varian S.p.A., Turin (IT)

( * ) Notice: Subject to any disclaimer, the term of this patent is extended or adjusted under 35 U.S.C. 154(b) by 0 days.

(21) Appl. No.: 10/159,911

(22) Filed: May 31, 2002

(65) Prior Publication Data

US 2003/0223859 A1 Dec. 4, 2003

(51) Int. Cl.[7] ..... F04D 19/04
(52) U.S. Cl. ..... 415/90; 73/40.7
(58) Field of Search ..... 415/90, 116, 143; 417/250, 423.4; 73/40.7

(56) References Cited

U.S. PATENT DOCUMENTS 3,748,055 A * 7/1973 Becker et al. ..... 415/90
4,472,962 A 9/1984 Mennenga
4,550,593 A 11/1985 Reich
5,158,426 A * 10/1992 Casaro et al. ..... 415/90
5,585,548 A 12/1996 Grosse Bley et al.
5,733,104 A * 3/1998 Conrad et al. ..... 417/423.4
6,030,189 A 2/2000 Bohm et al.

FOREIGN PATENT DOCUMENTS

DE 39 22 782 A 2/1990
DE 199 37 393 A 2/2001
JP 60-62692 A * 4/1985 ..... 415/90
SU 222587 A * 11/1968 ..... 415/90

* cited by examiner

*Primary Examiner*—Christopher Verdier
(74) *Attorney, Agent, or Firm*—Bella Fishman

(57) ABSTRACT

A turbine pump has a transition chamber (9), which separates a low-pressure section (1B) from a high-pressure section (1A) and into which an additional inlet port (5) opens. The chamber (9) is defined by a stator stage (10) consisting of a disc (11) with a peripheral edge (12), integral with said disc (11) and forming a spacer ring integrated into the stator stage, and with radial blades (17) joined with the disc (11) at both ends.

9 Claims, 5 Drawing Sheets

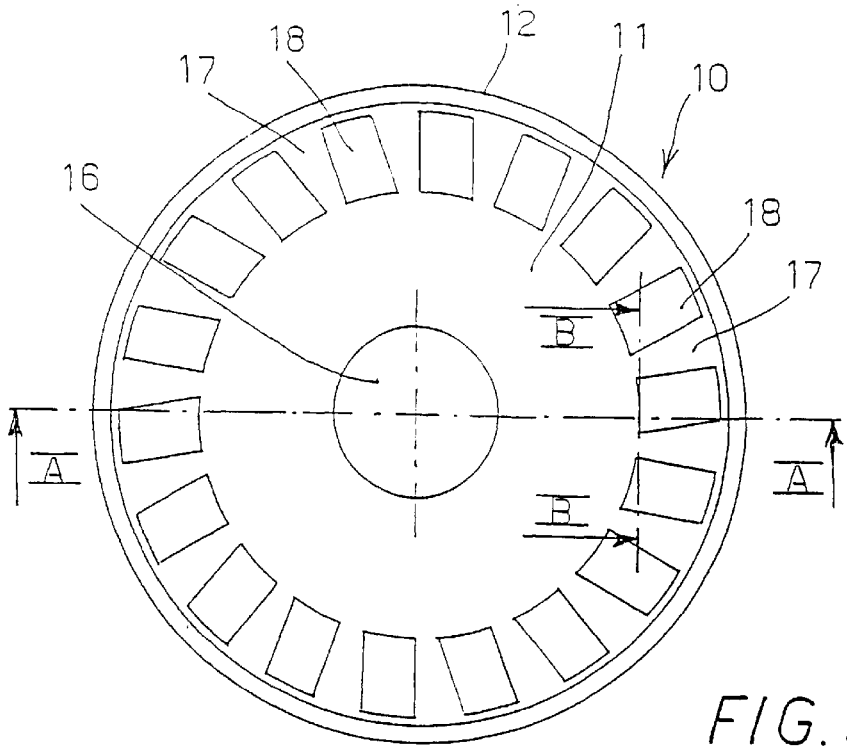
FIG. 3
FIG. 4
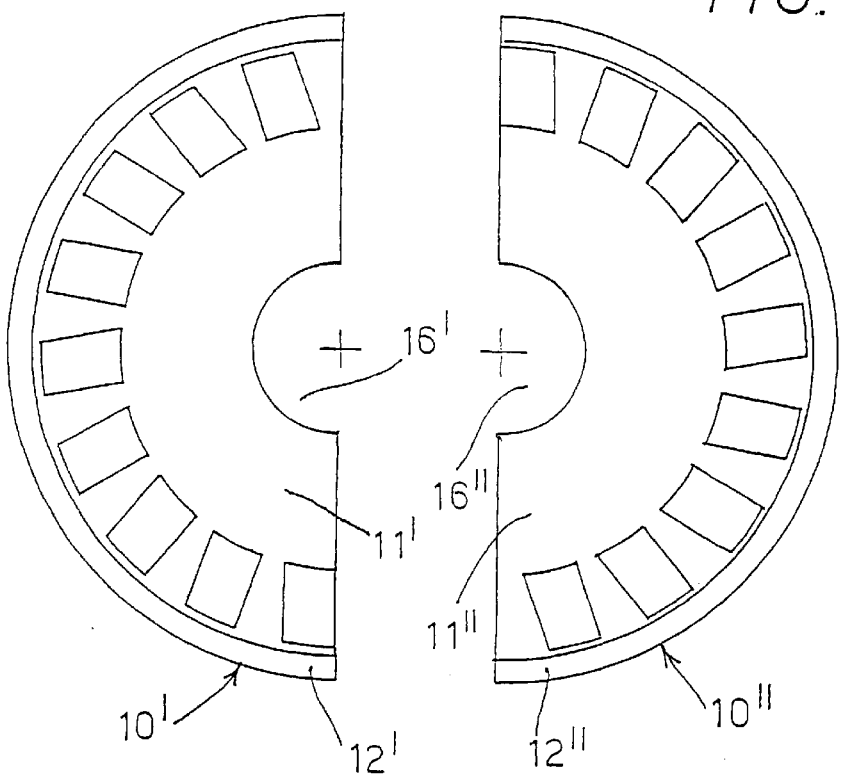

TURBINE PUMP WITH A STATOR STAGE INTEGRATED WITH A SPACER RING

FIELD OF THE INVENTION

The present invention refers to high-vacuum pumps, and more particularly it concerns a turbine pump, in particular a turbomolecular pump, comprising a stator stage integrated with a spacer ring and located in correspondence of an intermediate inlet for a gas flowing in counter-current flow to the operating direction of the pump.

BACKGROUND OF THE INVENTION

Pumps with such an intermediate inlet are employed for example, in leak detectors. In leak detectors a test gas, usually helium, which enters a vessel to be tested or escapes therefrom because of leaks, is led to the intermediate inlet of the pump, then it flows in counter-current flow towards a gas detector, usually a mass spectrometer, connected to the low-pressure side of the pump.

Examples of such pumps are disclosed in U.S. Pat. No. 4,472,962 entitled "Low Pressure Leak-Detector" issued Sep. 25, 1984 and U.S. Pat. No. 5,585,548 entitled "Counterflow Leak-Detector Unit With A High-Vacuum Pump" issued Dec. 17, 1996.

The '962 patent discloses a pump in which the intermediate inlet opens into an annular channel, formed in the pump housing and surrounding the rotor of an intermediate pumping stage. That pump requires a relatively high vacuum in the area where the test gas enters, a vacuum of the order of $10^{-5}$ mbar, (1 mPa).

The '548 patent discloses a pump in which the intermediate inlet opens into a transition chamber separating a group of low-pressure stages and a group of high-pressure stages. The chamber is limited upwards by a rotor impeller and downwards by a stator stage comprising a stationary disc, defining with the rotor shaft a constriction intended for providing a high detection sensitivity without any danger of the pressure in the test gas detector increasing to inadmissible levels. In an embodiment, the disc has a set of axially projecting strips. This pump does not require a relatively high vacuum in the inlet area of the test gas, where it tolerates pressures of the order of 0.1 mbar (10 Pa).

Therefore it is desirable to provide a pump with an intermediate inlet, exhibiting improved performance in terms of compression ratio and conductance of the test gas, such as helium, in order to increase the maximum pressure that can be tolerated at the intermediate port through which the test gas enters.

SUMMARY OF THE INVENTION

The present invention provides a pump where the transition chamber is limited by a stator stage integrated with a spacer ring and comprising a disc having a peripheral edge, integral with the disc and forming the spacer ring, and radial blades formed in a peripheral region of the disc and joined therewith at both a radially inner edge and a radially outer edge.

The above and other features of the present invention will become apparent from the following description of a preferred embodiment, given by way of non limiting example and shown in the accompanying drawings.

BRIEF DESCRIPTION OF THE DRAWINGS

FIG. 3 is a plan view of the stator stage shown in FIG. 2;

FIG. 4 is a plan view showing the stator stage divided into two halves for allowing mounting on the rotor;

DETAILED DESCRIPTION OF THE INVENTION

The present invention will be described in conjunction with an embodiment shown in FIG. 1.

Figure 1:
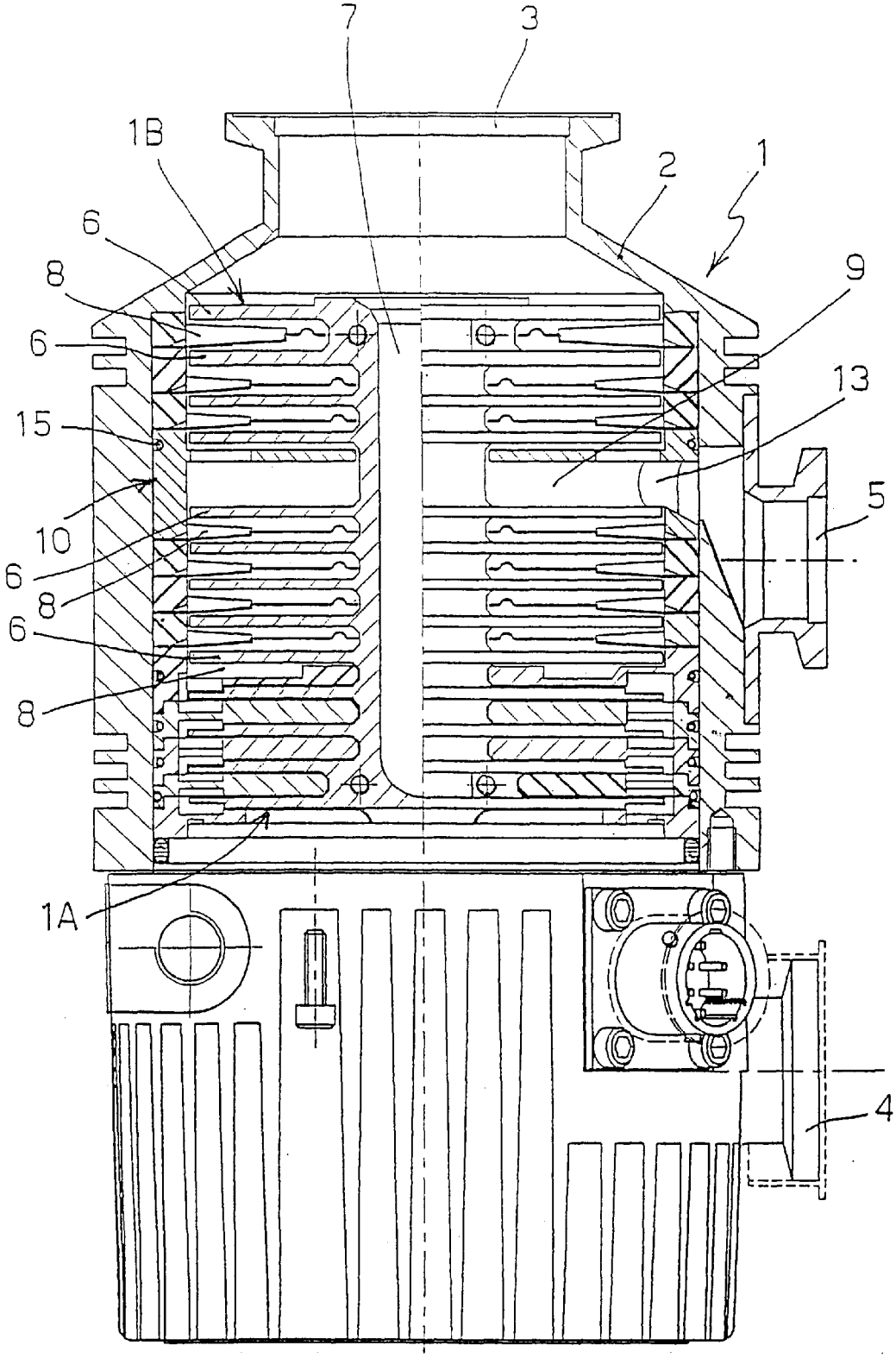
FIG. 1 is a schematical cross-sectional view of a pump with an intermediate inlet, according to the present invention.
Figure 2:
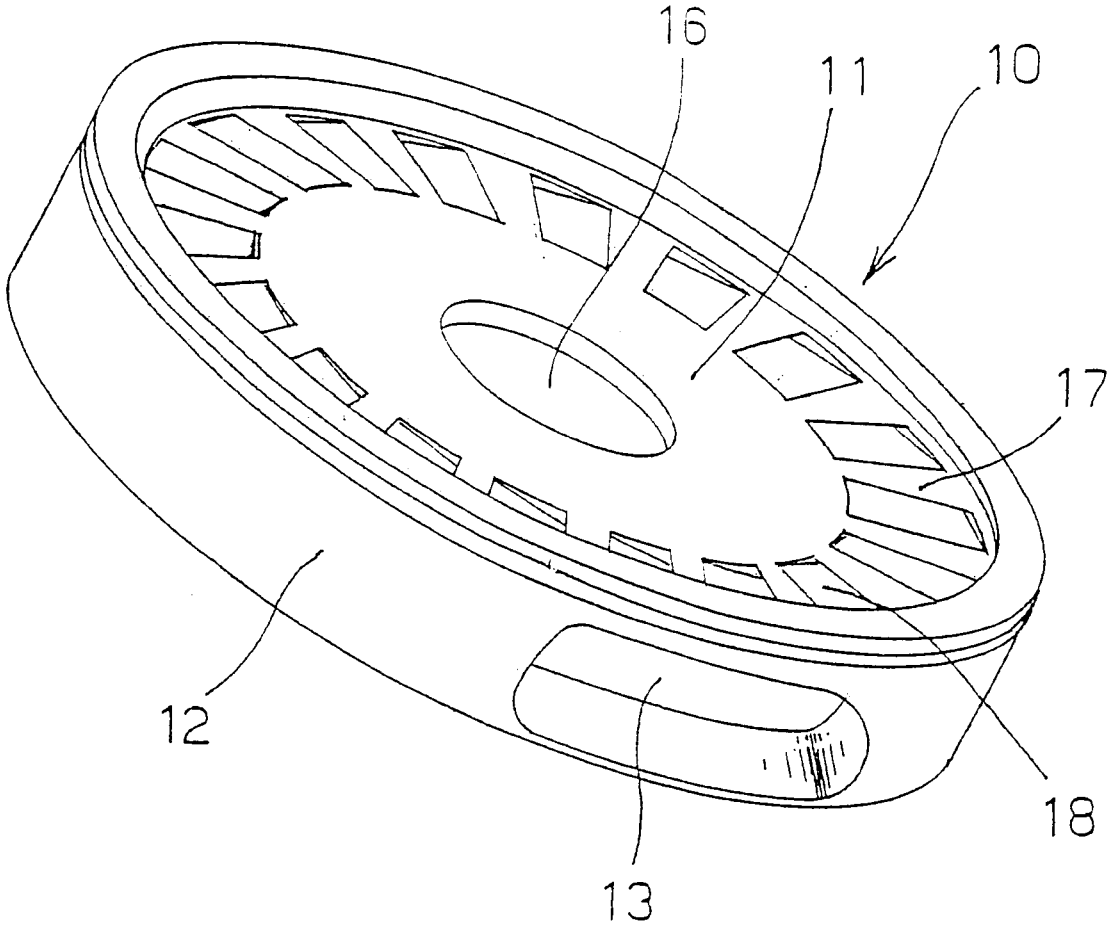
FIG. 2 is a perspective view of the stator stage located in correspondence with the intermediate inlet according to the present invention.
Figure 5:
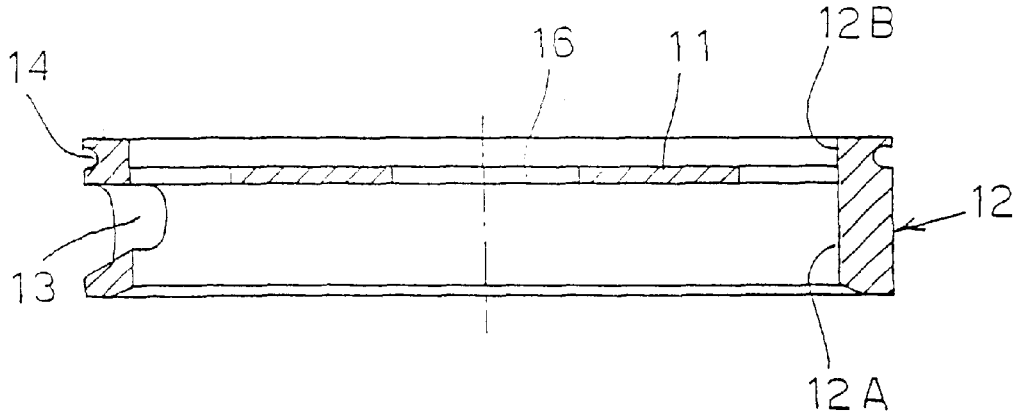
FIG. 5 is a cross-sectional view according to a plane passing through line A—A in FIG. 3.

In FIG. 1, the turbomolecular pump generally designated 1, has a housing 2 having a low-pressure inlet 3 that, in the application of the pump to a leak detector, is connected to the test gas detector, (not shown); a high-pressure outlet 4, communicating with the atmosphere or a fore-pump; and an intermediate inlet 5 for the test gas, intended to flow in counter-current flow towards the detector. The turbomolecular pump 1 has multiple stages, each associated with a rotor impeller 6, carried by a shaft 7. Rotor impellers 6 cooperate with stator stages 8 arranged along the walls of housing 2. Intermediate inlet 5 opens into a transition chamber 9, separating a high-pressure pump section (the lower section), from a low-pressure pump section (the upper one). The two sections are designated 1A and 1B, respectively. Section 1B is the section operating in counter-current flow in the application to a leak detector.

No rotor impeller is provided in correspondence with transition chamber 9 (therefore the pump has one pumping stage less than conventional pumps), and the chamber is limited upwards by a stator stage 10. The remaining stator stages 8, as well as rotor impellers 6, are of a conventional type.

Referring to FIGS. 2 to 6, stator stage 10 is a substantially cup-like member, comprising a disc 11 with a central bore 16 where rotor shaft 7 passes, and a side wall 12, integral with disc 11 and acting as a spacer ring. Such a structure allows a precise location of stator stage 10 within transition chamber 9. As shown in FIG. 4, stator stage 10 in effect comprises two identical portions 10', 10" that can be separated to allow mounting the stator about rotor shaft 7. The two portions are obtained by cutting stator stage 10 along a diameter at the end of the manufacture. In FIG. 4, the elements in the two portions are designated by reference numerals with a prime or a double prime, respectively.

Side wall 12 axially projects from disc 11 at both sides thereof and, as shown in FIG. 1, its total height substantially corresponds with the spacing between the last stator stage 8 of low pressure section 1B and the first stator stage 8 of high pressure section 1A. Portion 12A (FIG. 5) that, when the stator is mounted, is located on the side of high pressure pump section 1A, is higher than the other portion and has a high-conductance opening 13 formed therein, which communicates with intermediate inlet 5. Portion 12B located on the low pressure side has instead an annular groove 14 housing a resilient ring 15 (FIG. 1) arranged to keep the two halves 10', 10" of stator stage 10 in contact.

A plurality of radial blades 17 is arranged along a peripheral portion of disc 11. Said blades are regularly spaced along the circumference of disc 11 and are separated by channels 18 passing through the whole thickness of disc 11. Blades 17 are joined with disc 11 not only at their radially inner edges, but also at their radially outer edges, where they end in correspondence of spacer ring 12. Also the corresponding separation channels 18 are thus closed at both ends.

Figure 6:
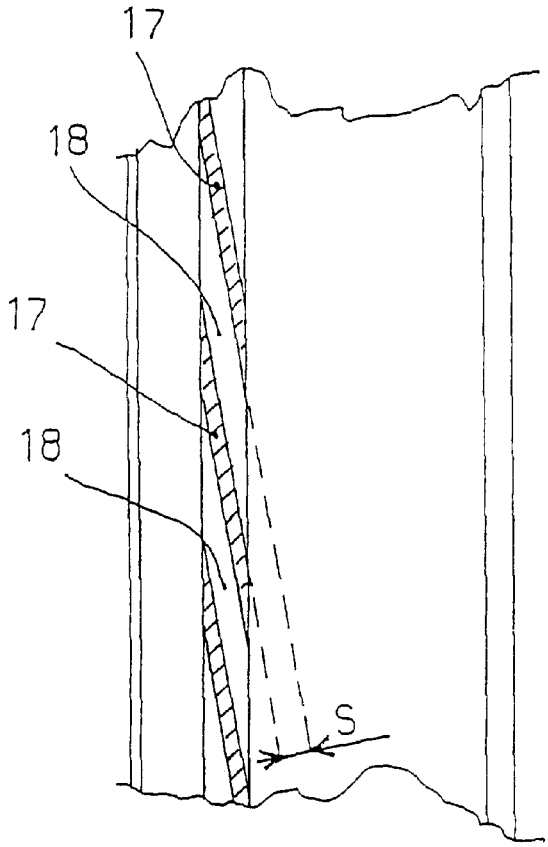
FIG. 6 is a cross-sectional view according to a plane passing through line B—B in FIG. 3.

As clearly shown in FIG. 6, blades 17 form a very narrow angle with the plane of disc 11, and adjacent blades 17 overlap, leaving very narrow channels therebetween, so that the stage is made optically opaque in the axial direction. In the embodiment shown, with eighteen blades, the angle is of about 10° and the separation channels have a constant thickness s of about 1 mm in the radial direction. Those values allow attaining, at stator stage 10, a compression ratio of 2 for nitrogen and maintaining a molecular gas flow in the direction from inlet 3 to outlet 4 up to pressures as high as about 100 mtorr (1,333 Pa)—that is the pump can tolerate a pressure of 1,333 Pa in the transition chamber—without losing the compression capacity of the upper stages.

Figure 7:
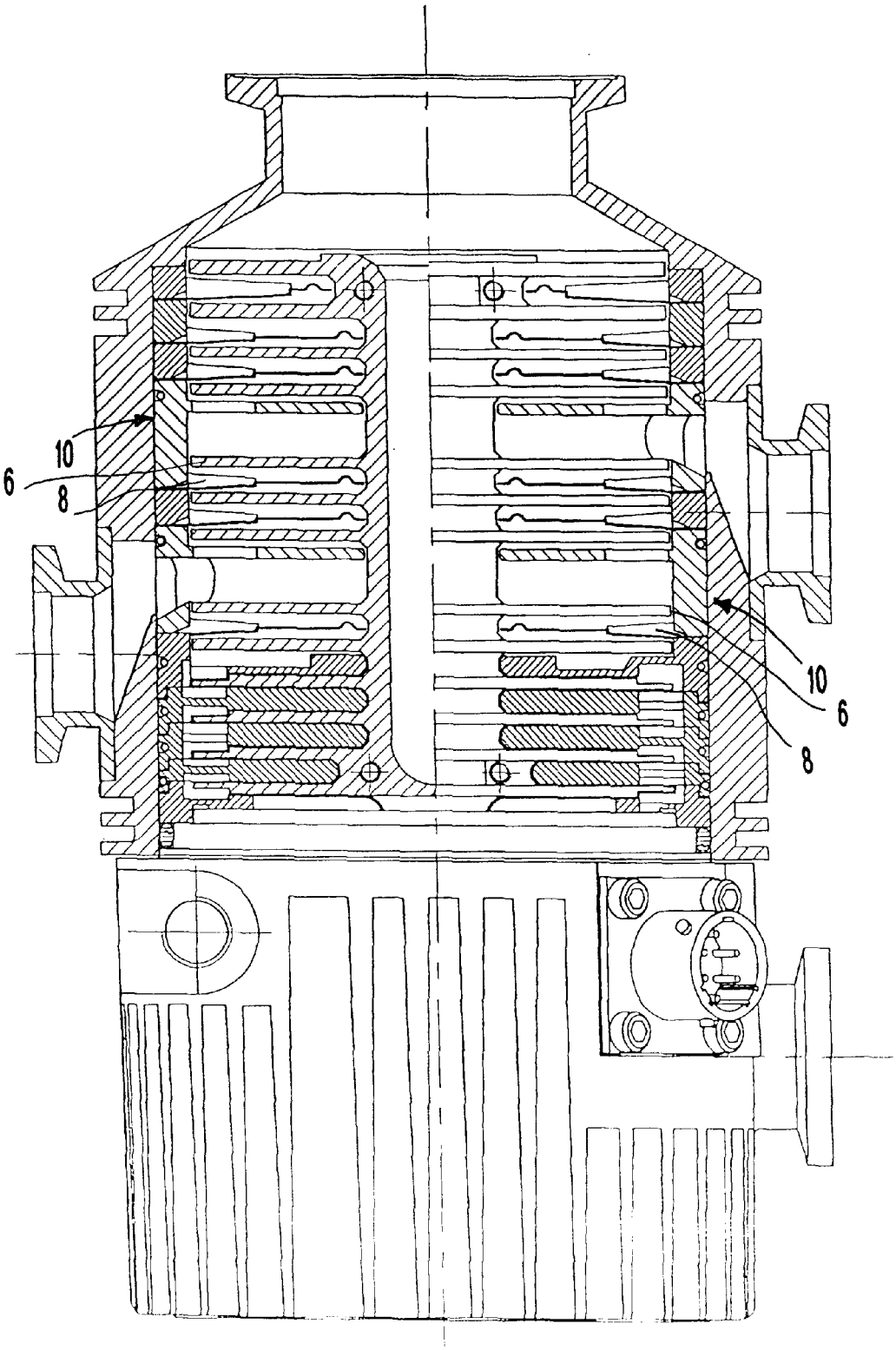
FIG. 7 is a schematical cross-sectional view of a pump with a plurality of stator stages located in correspondence with the intermediate inlets according to the present invention.

It is evident that the above description is given only by way of non-limiting example and that changes and modifications are possible without departing from the scope of the invention. In particular, the pump that is shown in FIG. 7 could include a plurality of stator stages made like stage 10.

What is claimed is:

1. A turbine pump comprising:

a transition chamber (9) at an intermediate pressure separating a low-pressure section (1B) from a high-pressure section (1A), an intermediate inlet (5) opening into said transition chamber (9), and a stator stage (10) integrated with a spacer ring and comprising a disc (11) having a peripheral edge (12) axially projecting therefrom in opposite directions and to different extents in both directions having a portion (12A) projecting to a greater extent with a high conductance opening (13) communicating with said intermediate inlet (5), said peripheral edge being integral with said disc (11) and forming said spacer ring, and radial blades (17) located at the periphery of disc (11) and joined therewith at both a radially inner edge and a radially outer edge.

2. The pump according to claim 1, characterised in that said blades are arranged at an acute angle relative to the surface of the disc (11) such that adjacent blades (17) overlap, with the interposition of separation channels (18) that pass through the whole thickness of the disc (11), so as to make the stage optically opaque in an axial direction.

3. The pump according to claim 2, characterised in that said acute angle is of the order of about 10°.

4. The pump according to claim 2, characterised in that said separation channels (18) have a radially constant and defined thickness (s).

5. The pump according to claim 4, characterised in that said thickness (s) is in the range 0.5 to 2 mm.

6. The pump according to claim 1, characterised in that said portion (12A) projecting to a greater extent is the portion located on the side of the high pressure section (1A).

7. The pump according to claim 1, characterised in that said spacer ring (12) has, in a portion (12B) projecting to a lesser extent, an annular groove (14) housing a resilient ring (15) arranged to keep two halves (10', 10") of the stator stage (10) in contact.

8. The pump according to any of the preceding claims, characterised in that said stator stage (10) has a central bore (16) where a rotor shaft (7) passes, and it is divided into two identical portions (10', 10") along a diametrical line, to allow mounting the,stage (10) about said shaft (7).

9. The pump according to claim 1, characterised in that it comprises at least a further stator stage integrated with a spacer ring.

* * * * *